US007137688B1

(12) United States Patent
Andersen et al.

(10) Patent No.: US 7,137,688 B1
(45) Date of Patent: Nov. 21, 2006

(54) OPTICAL INK LEVEL DETECTING ARRANGEMENTS FOR INK CARTRIDGES

(75) Inventors: Stephen A. Andersen, Thompson's Station, TN (US); Dennis M. Lengyel, Hemlock, NY (US)

(73) Assignee: Nu-Kote International, Inc., Franklin, TN (US)

( * ) Notice: Subject to any disclaimer, the term of this patent is extended or adjusted under 35 U.S.C. 154(b) by 230 days.

(21) Appl. No.: 10/826,330

(22) Filed: Apr. 19, 2004

(51) Int. Cl.
*B41J 2/045* (2006.01)

(52) U.S. Cl. ..... 347/70

(58) Field of Classification Search ..... 347/70, 347/85–86, 56, 19
See application file for complete search history.

(56) References Cited

U.S. PATENT DOCUMENTS 4,783,137 A * 11/1988 Kosman et al. ..... 385/53
5,616,929 A 4/1997 Hara
6,361,136 B1 3/2002 Watanabe et al.
6,726,313 B1 * 4/2004 Oda et al. ..... 347/85
6,767,075 B1 * 7/2004 Takada et al. ..... 347/19
6,869,158 B1 * 3/2005 Kojima et al. ..... 347/19
6,966,642 B1 * 11/2005 Hanaoka et al. ..... 347/86

* cited by examiner

*Primary Examiner*—K. Feggins
(74) *Attorney, Agent, or Firm*—Fay, Sharpe, Fagan, Minnich & McKee, LLP

(57) ABSTRACT

An ink container shell for an ink jet cartridge has an ink chamber provided with an optical ink detection device in the form of a single or multi-segment prism having interface surfaces for reflecting light in a scan plane from a first to a second exterior area relative to the container shell when an ink level in the chamber recedes to a given level. The multi-segment prism provides for scanning a cartridge in different scanning planes. Either a single prism or the multi-segment prism can be separate from the cartridge and interengaged therewith by a snap-fit.

25 Claims, 2 Drawing Sheets

OPTICAL INK LEVEL DETECTING ARRANGEMENTS FOR INK CARTRIDGES

BACKGROUND OF THE INVENTION

It is of course known to provide ink cartridges for printers with arrangements for optically detecting the level of ink in a chamber or chambers of an ink cartridge. Generally, the optical system includes an optical ink detecting section, such as a prism, in an ink chamber of a cartridge and which is immersed in the ink when the latter is in the chamber above a certain level, and the ink level is read by a light emitting optical unit comprising a light emission device and a photo receptor outside the cartridge. The interface of the optical detecting section extends transverse to the plane of scanning as defined by the light path between the emitter and receptor. If, for example, the scanning takes place in a printer, and the cartridge moves transverse to the direction between the front and rear ends thereof, the plane of the light path between the emitter and receptor is likewise transverse to the direction between the front and rear ends of the cartridge, whereby the light enters the detecting section and reflects off the interface thereof to the receptor. The amount of light which is reflected to the receptor is indicative of the level of ink in the chamber. Such level detecting arrangements are shown, for example, in patents U.S. Pat. No. 5,616,929 to Hara and U.S. Pat. No. 6,361,136 to Watanabe, et al.

It will be appreciated of course that at least the portion of the cartridge in which the level detector is disposed of light transmitting material, and that the light used for determining the ink level can either be visible light or infrared. Ink level detectors such as prisms provided in ink cartridges for use in a single printhead printer are in a single plane of alignment with the plane of the light path of the light emitting optical unit. At the same time, a printer with multiple printheads can have black and color ink cartridges in different scanning or alignment planes. Accordingly, two different ink cartridge configurations are required for use in single and multiple printhead printers. Furthermore, optical prisms provided in cartridges heretofore available are formed integral with the bottom wall of the cartridge and, accordingly, limit the versatility with respect to the plastic materials which can be used for constructing the cartridges.

SUMMARY OF THE INVENTION

In accordance with the present invention, improvements are provided with respect to optical prism arrangements for ink jet cartridges by which the foregoing and other disadvantages of cartridges heretofore available are minimized or overcome. More particularly in this respect, and in accordance with one aspect of the invention, multiple, independent prism segments are provided in an ink cartridge which allows one cartridge configuration to be used in single or multi-printhead printers. The interface of each of the prisms is in a corresponding plane transverse to the direction between the front and rear ends of the cartridge, whereby the cartridge has the ability to detect ink levels in connection with a plurality of different scanning planes which are parallel and spaced apart in the direction between the front and rear ends of the cartridge. A further advantage with respect to multiple prism segments is realized in connection with the molding of the plastic materials of the cartridge. In this respect, the individual prisms are relatively thin with respect to the scanning plane and, according, are easier to mold without problems due to cooling a larger mass of plastic material which can result in defects in the prism surfaces which can cause the prism to be non-functional.

In accordance with another aspect of the invention, single or multiple prism components are separate from and assembled with a cartridge to provide an ink level detecting arrangement therefor. The prism or prisms can be mounted in a recess in a chamber wall of a cartridge together with an optical gel which will allow the interface of the prism to become optically transmissive. Alternatively, the prism unit can be assembled with the cartridge so as to be directly exposed to ink in the ink chamber. Preferably, the level detector is removably interengaged with the cartridge, such as through a snap fit. However, the detector could be separate from and permanently attached to a cartridge, such as by heat welding. A primary advantage of the two piece prism-cartridge arrangement is to enable the use of unlike types of plastic materials for the cartridge and detector components.

It is accordingly, an outstanding object of the present invention to provide improvements in connection with optical ink level detecting arrangements in ink cartridges.

Another object is the provision of an ink cartridge with an ink level detecting arrangement which enables the cartridge to be used in single or multi-printhead configuration printers.

Another object is the provision of an optical ink level detecting arrangement for an ink cartridge in which an optical prism or prisms and the cartridge can be of different plastic materials.

Another object is the provision of an ink level detecting arrangement for an ink cartridge in which an optical prism element is separate from and assembled with an ink cartridge.

BRIEF DESCRIPTION OF THE DRAWINGS

The foregoing objects, and others, will in part be obvious and in part pointed out more fully hereinafter in conjunction with the written description of preferred embodiments of the invention illustrated in the accompanying drawings in which.

DESCRIPTION OF PREFERRED EMBODIMENTS

Figure 1:
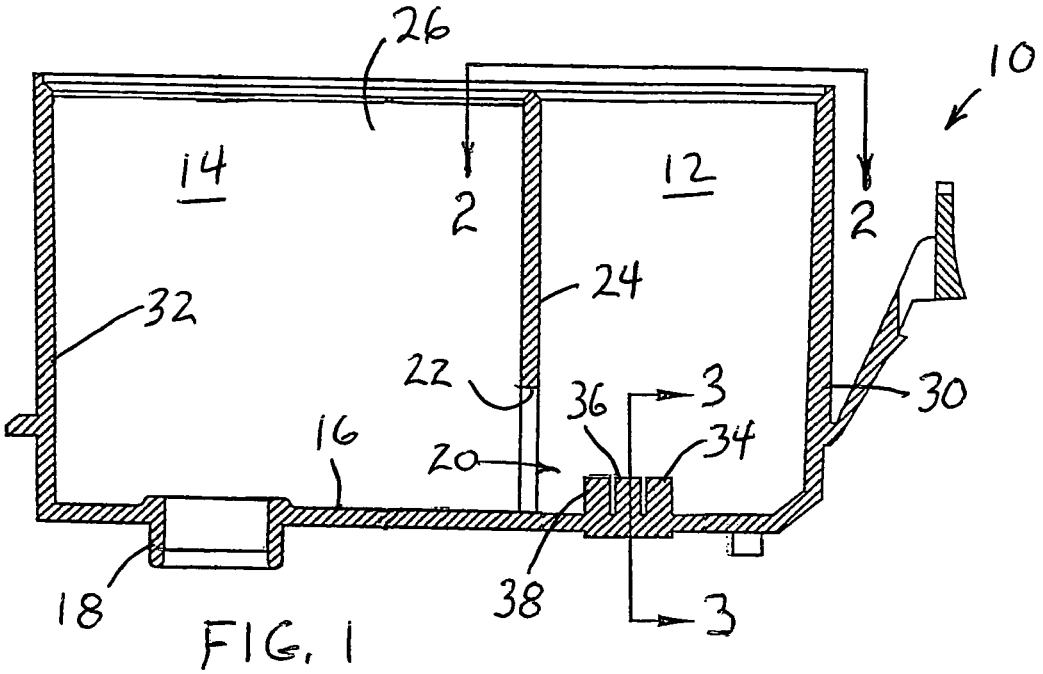
FIG. 1 is a sectional elevation view of an ink cartridge having a multi-segmented ink level detecting prism in accordance with the present invention.
Figure 2:
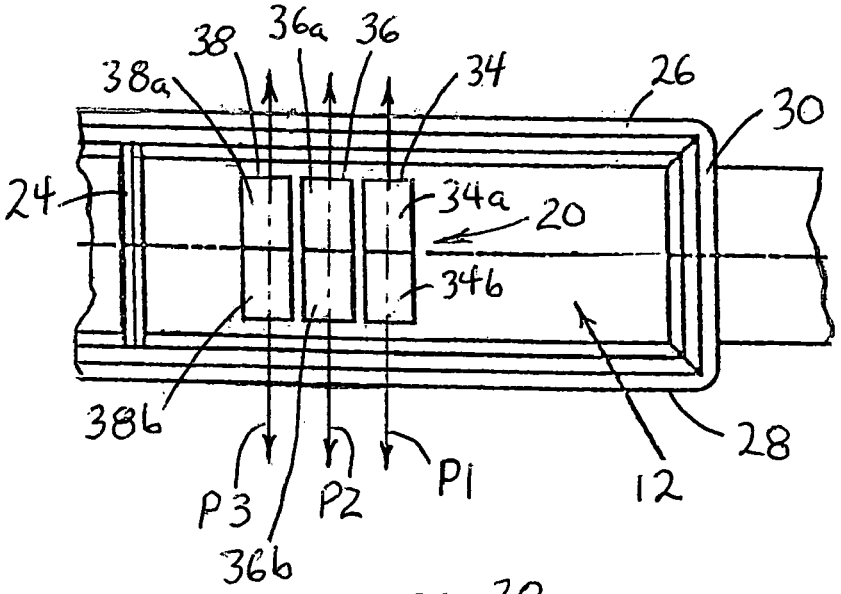
FIG. 2 is an enlarged plan view of the prism segments looking in the direction of line 2—2 in FIG. 1.
Figure 3:
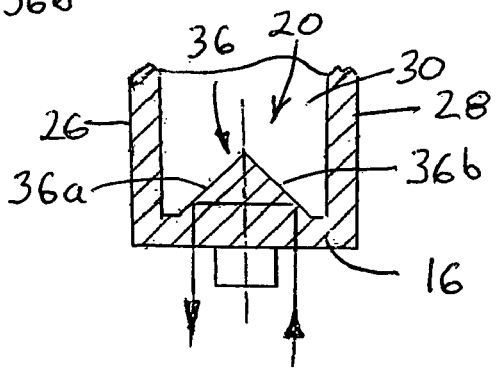
FIG. 3 is an enlarged cross-sectional elevation view of the prism segments along line 3—3 in FIG. 1.

Referring now in greater detail to the drawings, wherein the showings are for the purpose of illustrating preferred embodiments of the invention only and not for the purpose of limiting the invention, FIGS. 1–3 illustrate an ink cartridge 10 having ink chambers 12 and 14 and a bottom wall 16 having an ink outlet 18 from chamber 14 and an optical prism unit 20 in chamber 12. While not shown, chamber 14 is generally provided with a block of porous ink absorbing material, and chamber 12 generally receives free ink which is progressively fed to the ink absorbing material in chamber 14 through a window or opening 22 in a partition wall 24 which divides the interior of the cartridge into the two chambers. The cartridge further includes side walls 26 and 28 and front and rear walls 30 and 32, respectively.

In accordance with this embodiment, at least the portion of bottom wall 16 supporting the optical prism is of light transmitting material, and optical prism unit 20 comprises three individual prisms 34, 36 and 38 each of which, as will be appreciated from FIGS. 2 and 3, includes a corresponding interface defined by angularly related surfaces 34*a* and 34*b*, 36*a* and 36*b*, and 38*a*. The surfaces of each pair of surfaces are preferably at an angle of 90° to one another. When the cartridge is mounted in a printer carriage, the cartridge moves therewith along a path in a direction transverse to the direction between the front and rear ends of the cartridge and which direction is indicated in FIG. 2 of the drawings by arrows P1, P2 and P3 which laterally bisect prisms 34, 36 and 38, respectively. Arrows P1, P2 and P3 also represent potential alignment planes between the corresponding prism and a light emitting optical unit by which an ink level can be detected and indicated via the optical unit. The prisms 34, 36 and 38 can be produced in connection with the molding process for the bottom wall of the cartridge or, alternatively, can be provided by cutting a unitary molded prism component into three segments. Further, as will become apparent hereinafter, the three segment prism unit can be produced separate from the cartridge and assembled therewith.

Figure 4:
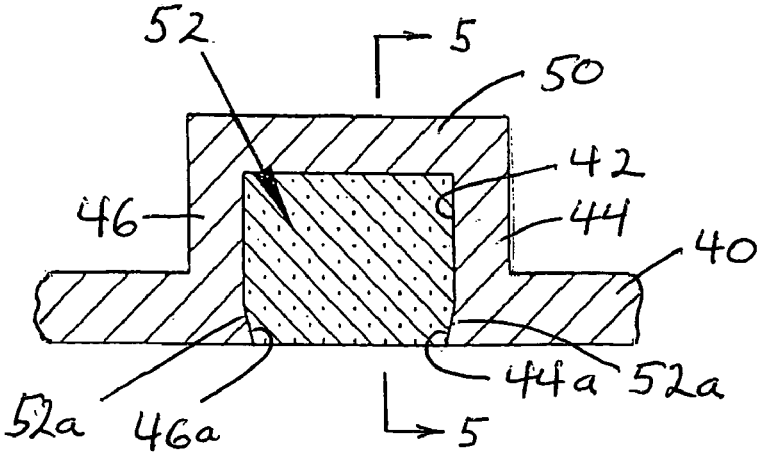
FIG. 4 is an enlarged sectional elevation view of the bottom wall of an ink cartridge having a cavity and an optical prism assembled therewith in accordance with another embodiment of the invention.
Figure 5:
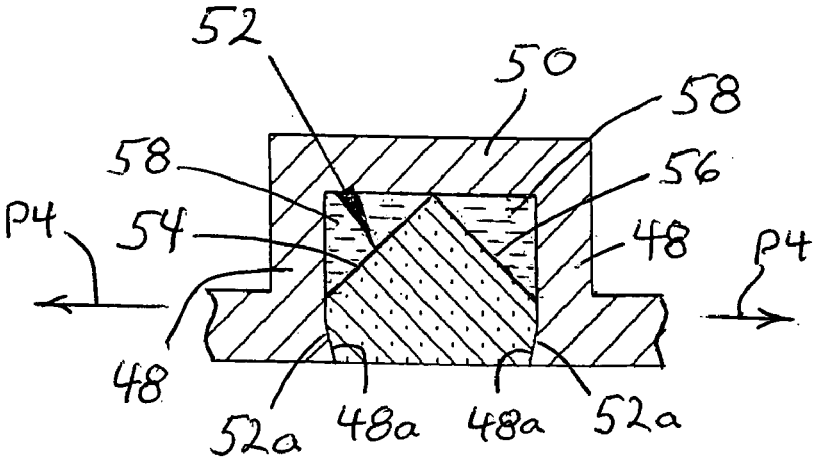
FIG. 5 is a cross-sectional elevation view of the prism looking in the direction of line 5—5 in FIG. 4; and, FIG. 6 is a cross-sectional elevation view through a prism component mounted on a bottom wall of an ink cartridge in accordance with yet another embodiment of the invention.

Referring now to FIGS. 4 and 5 of the drawing, the bottom wall 40 of a cartridge is provided with a downwardly open recess 42 which, in the direction between the front and rear ends of the cartridge, is provided with front and rear walls 44 and 46, respectively, side walls 48 and a bottom or inner wall 50. The lower ends of the inner sides of walls 44, 46 and 48 are provided with corresponding undercut portions 44*a*, 46*a* and 48*a* which provide for a prism component 52 having corresponding undercut portions 52*a* to be received in recess 42 and interengaged therewith by a snap-fit therebetween. As will be appreciated from the embodiment shown in FIGS. 2 and 3, prism component 52 has angularly related surfaces 54 and 56 which are bisected by an alignment plane parallel to the plane of FIG. 5. The cartridge, and thus the prism, moves along the alignment plane as indicated by arrows P4, for the prism to traverse the light emitting and receptor component of a light emitting optical unit operable to detect the level of ink in the cartridge. Preferably, the areas between prism surfaces 54 and 56 and the corresponding portions of recess walls 48 and 50 are filled with an optical gel 58 which optimizes the optically transmissive characteristic of prism surfaces 54 and 56.

Figure 6:
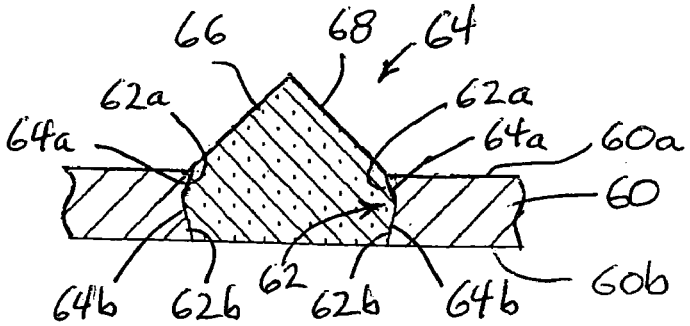

Referring now to FIG. 6 of the drawing, the bottom wall 60 of an ink cartridge is provided with an opening 62 between the inner and outer surfaces 60*a* and 60*b*, respectively, of the bottom wall. Opening 62 is adapted to provide for the mounting of a prism component 64 on the bottom wall of the cartridge and, in the embodiment shown, such mounting is achieved by providing for opening 62 to have a shallow V-shaped configuration about the periphery thereof as defined by upper and lower surfaces 62*a* and 62*b*, respectively, and by providing for prism component 64 to have corresponding V-shaped upper and lower surfaces 64*a* and 64*b*, respectively, which provide for a snap-fit between the opening and prism. As will be appreciated from the description herein of the preceding embodiments, prism component 64 has angularly related surfaces 66 and 68 bisected by an alignment plane with respect to the path of light to one of the surfaces from a light emitting device of an optical unit and reflection of the light to the other surface and thence to a photo receptor of the optical unit.

As will be appreciated from the embodiments herein illustrated and described, a multiple segment prism component can be produced separate from an ink cartridge and assembled therewith or mounted thereon as shown in the embodiments of FIGS. 4–6 and that, with respect to such an assembly or those shown in FIGS. 4–6, the prism component can be permanently assembled with the cartridge such as by an adhesive bond or heat seal.

While considerable emphasis has been placed herein on the structures and structural interrelationships between the component parts of preferred embodiments, it will be appreciated that other embodiments can be devised and that many changes can be made in the preferred embodiments without departing from the principals of the present invention. In this respect, for example, the light detecting elements can be of a configuration other than triangular, and can be on a wall of a cartridge other than the bottom wall. Accordingly, it is to be distinctly understood that the foregoing descriptive matter is to be interpreted merely as illustrative of the present invention and not as a limitation. Further, it is intended to include all such modifications and alternate embodiments in the appended claims insofar as they are within the scope of the claims or equivalents thereof.

Having thus described the invention, it is so claimed:

1. In an ink container shell for an ink jet cartridge having a chamber for receiving ink and an optical ink detection device in the chamber, said device including an interface surface for reflecting light in a scan plane from a first to a second exterior area relative to the container shell when an ink level in the chamber recedes to a given level, the improvement comprising: said ink detection device including at least two elements, wherein said at least two elements include a recess of light transmitting material in a wall of the chamber and an optical prism releasably held in said recess.

2. The improvement according to claim 1, and an optical gel between said recess and said prism.

3. The improvement according to claim 2, wherein said prism is triangular.

4. The improvement according to claim 3, wherein said prism has a snap-fit interengagement with said recess.

5. The improvement according to claim 4, wherein said wall of said chamber is a bottom wall.

6. The improvement according to claim 1, wherein said prism has a snap-fit interengagement with said recess.

7. The improvement according to claim 6, and an optical gel between said recess and said prism.

8. The improvement according to claim 7, said wall of said chamber is a bottom wall.

9. The improvement according to claim 1, wherein said wall of said chamber is a bottom wall.

10. The improvement according to claim 1, wherein said at least two elements include separate first and second optical prisms adjacent one another in said chamber.

11. The improvement according to claim 10, wherein said at least two elements includes a third optical prism separate from and adjacent one of said first and second prisms.

12. The improvement according to claim 11, wherein each said first, second and third optical prism is triangular.

13. The improvement according to claim 10, wherein said chamber includes a wall and said first and second prisms are on said wall.

14. The improvement according to claim 13, wherein said first and second prisms are integral with said wall.

15. The improvement according to claim 14, wherein said at least two elements includes a third optical prism separate from and adjacent one of said first and second prisms.

16. The improvement according to claim 15, wherein each said first, second and third optical prism is triangular.

17. The improvement according to claim 13, wherein said wall is a bottom wall and said first and second prisms are integral with said bottom wall.

18. The improvement according to claim 17, and a third optical prism on and integral with said bottom wall, said third prism being separate from said first and second prisms.

19. The improvement according to claim 18, wherein each said first, second and third optical prism is triangular.

20. The improvement according to claim 1, wherein said at least two elements include at least one optical prism separate from said shell and mounting elements on said shell and prism for mounting said prism on said shell.

21. The improvement according to claim 20, wherein said mounting elements include an opening in said shell and interengaging snap-fit components in said opening and on said prism.

22. In an ink container shell for an ink jet cartridge having a chamber for receiving ink and an optical ink detection device in the chamber, said device including an interface surface for reflecting light in a scan plane from a first to a second exterior area relative to the container shell when an ink level in the chamber recedes to a given level, the improvement comprising: said ink detection device including at least two elements, wherein said at least two elements include a recess or opening in a wall of the chamber and an optical prism received in said recess or opening and formed from a material dissimilar from the cartridge.

23. The improvement according to claim 22, wherein said prism is releasably held in said recess.

24. The improvement according to claim 23, and an optical gel between said recess and said prism.

25. The improvement according to claim 24, wherein said prism is triangular.

* * * * *